US010549940B2

(12) United States Patent
Totani et al.

(10) Patent No.: US 10,549,940 B2
(45) Date of Patent: Feb. 4, 2020

(54) SHEET PRODUCT STACKING AND FEEDING APPARATUS

(71) Applicant: Totani Corporation, Kyoto (JP)

(72) Inventors: Mikio Totani, Kyoto (JP); Hisayuki Ito, Kyoto (JP); Akira Hasuo, Kyoto (JP); Masashi Hagino, Kyoto (JP); Tomohiko Sembo, Kyoto (JP); Soichiro Tanikura, Kyoto (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 15/752,605

(22) PCT Filed: Jun. 15, 2016

(86) PCT No.: PCT/JP2016/067735
§ 371 (c)(1),
(2) Date: Feb. 14, 2018

(87) PCT Pub. No.: WO2017/051569
PCT Pub. Date: Mar. 30, 2017

(65) Prior Publication Data

US 2018/0237250 A1 Aug. 23, 2018

(30) Foreign Application Priority Data

Sep. 25, 2015 (JP) ..... 2015-188306

(51) Int. Cl.
*B31B 70/98* (2017.01)
*B31B 70/02* (2017.01)
(Continued)

(52) U.S. Cl.
CPC ..... *B65H 31/32* (2013.01); *B65H 31/26* (2013.01); *B65H 31/3054* (2013.01); *B65H 29/14* (2013.01); *B65H 2301/4212* (2013.01)

(58) Field of Classification Search
CPC ..... B65H 31/32; B65H 31/3027; B65H 2301/42242; B65H 2301/42262;
(Continued)

(56) References Cited

U.S. PATENT DOCUMENTS 3,362,707 A 1/1968 Lauren
3,638,538 A * 2/1972 Sullivan ..... B65H 29/66 414/788.1
(Continued)

FOREIGN PATENT DOCUMENTS

JP S53-164527 12/1978
JP S60-078730 5/1985
(Continued)

OTHER PUBLICATIONS

International Search Report dated Sep. 6, 2016 in corresponding International patent application No. PCT/JP2016/067735.
(Continued)

*Primary Examiner* — Gregory W Adams
(74) *Attorney, Agent, or Firm* — Kirschstein, Israel, Schiffmiller & Pieroni, P.C.

(57) ABSTRACT

When sheet products 1 are discharged, the sheet products are collided against shutter bars 5 so as to fall and stack on a feed conveyor 4. Then, each of protrusion bodies 7 and 8 are lowered by a first drive 9 so as to nip the sheet products between the protrusion bodies and the feed conveyor. Then, coming products are successively discharged and stacked on the protrusion bodies. And then, a second drive 12 is operated in conjunction with the feed conveyor so as to feed the sheet products nipped between the protrusion bodies and the feed conveyor 4. The shutter bars 5 are elevated and lowered by a third drive for adjusting the height position thereof.

10 Claims, 20 Drawing Sheets

(51) Int. Cl.
*B65H 31/32* (2006.01)
*B65H 31/30* (2006.01)
*B65H 31/26* (2006.01)
*B65H 29/14* (2006.01)

(58) Field of Classification Search
CPC .... B65H 2301/42622; B65H 2405/323; B65H 2701/176; B65H 2701/191; B31B 50/98; B65G 57/03
USPC ..... 271/189, 207, 218, 220; 414/790.8
See application file for complete search history.

(56) References Cited

U.S. PATENT DOCUMENTS 3,892,168 A * 7/1975 Grobman ..... B65H 31/16 271/195
4,043,458 A * 8/1977 Schott, Jr. ..... B65H 31/32 271/213
4,297,066 A * 10/1981 Ramcke ..... B65H 31/3027 271/218
4,436,472 A * 3/1984 Kunzmann ..... B65H 31/3045 271/183
4,523,502 A * 6/1985 Besemann ..... B65H 31/3027 414/789.9
4,599,039 A * 7/1986 Neubuser ..... B65H 29/10 414/790.2
4,854,932 A * 8/1989 Schlottke ..... B65H 35/10 493/357
6,146,084 A * 11/2000 Doyle ..... B65G 57/035 414/788.9
2002/0150462 A1* 10/2002 Furthmuller ..... B65H 31/32 414/790.6
2005/0280203 A1* 12/2005 Ozcariz Eizaguirre ..... B65H 29/60 271/214
2010/0190626 A1* 7/2010 Taketsugu ..... B65G 57/03 493/56
2014/0148321 A1* 5/2014 Hatano ..... B65H 29/247 493/56

FOREIGN PATENT DOCUMENTS

JP S62-244864 10/1987
JP H07-228410 8/1995
JP 5439611 12/2013
WO 2011010864 1/2011

OTHER PUBLICATIONS

European Search Report dated Apr. 25, 2019 in corresponding European patent application No. 16848359.2.

* cited by examiner

SHEET PRODUCT STACKING AND FEEDING APPARATUS

TECHNICAL FIELD OF THE INVENTION

The invention relates to an apparatus for stacking and feeding sheet products discharged successively from a discharge position.

BACKGROUND OF THE INVENTION

As described in Patent Document 1, it is common that, in a machine for making plastic bags, the machine comprises a longitudinal heater, a cross heater and a cutter by which plastic films are heat sealed with each other longitudinally and widthwise thereof and cross cut widthwise, to successively make plastic bags. The plastic bags are then discharged successively. In the machine described in Patent Document 1, when the plastic bags are discharged, a predetermined number of the plastic bags are stacked and then fed.

Hereinafter, the machine of Patent Document 1 will be described. A plurality of catcher bars is opposite to a discharge position of the plastic bags above a feed conveyor. The catcher bars are spaced from each other and arranged in a lateral direction. A plurality of shutter bars is further disposed between the discharge position of the plastic bags and the catcher bars. The shutter bars are extended vertically and spaced from each other in the lateral direction. It should be understood that the lateral direction denotes a horizontal direction normal to the discharge direction. Thus, when the plastic bags are discharged, the plastic bags collide against the shutter bars so as to fall and stack on the feed conveyor. In addition, the catcher bars pass through between the shutter bars and protrude toward the discharge position of the plastic bags. The catcher bars receive coming plastic bags after the plastic bags are stacked. Then, the plastic bags are fed by the feed conveyor, and the catcher bars are retracted to their original position so that the coming plastic bags can fall onto the feed conveyor.

Therefore, a predetermined number of the plastic bags can be stacked on and then fed by the feed conveyor. However, there is a problem according to the type of the plastic bag. In case that the plastic films are heat sealed with each other longitudinally and widthwise thereof and cross cut widthwise so as to successively make the plastic bags, the plastic bags have a relatively high stiffness so as not to be very flexible. Thus, the plastic bags can fall onto the feed conveyor so as to be stacked on and then fed by it. However, the plastic bags do not always have a relatively high stiffness.

As described in Patent Document 2, for example, the plastic films are heat cut by a heat blade widthwise thereof, for making the plastic bags. The plastic bags are flexible to have a low stiffness. Therefore, in the machine of Patent Document 1, it is inappropriate that the plastic bags fall onto the feed conveyor so as to be stacked on and then fed by it. Because, there is a problem that the plastic bags may easily be out of alignment, slid and collapsed while being stacked on and then fed by the feed conveyor.

The machine of Patent Document 1 can stack and feed not only the plastic bags but also other sheet products discharged successively, but there is the same problem in feeding the sheet products which have a low stiffness, as described above.

It is, therefore, an object of the invention to provide an apparatus for stacking and feeding the sheet products discharged successively from a discharge position, in which the sheet products can be stacked and then fed reliably even though the sheet products have a low stiffness.

Patent Document 1: JP B5439611

Patent Document 2: JP A62-244864

SUMMARY OF THE INVENTION

According to the invention, an apparatus comprises a carriage spaced from a discharge position of sheet products in a discharge direction of the sheet products. The apparatus further comprises a plurality of shutter bars disposed between the discharge position of the sheet products and the carriage and above a feed conveyor. The sheet conveyor is extended in the discharge direction of the sheet products. The shutter bars are extended vertically and spaced from each other in a lateral direction. Thus, when the sheet products are discharged, the sheet products collide against the shutter bars so as to fall and stack on the feed conveyor. The apparatus further comprises a plurality of protrusion bodies mounted on the carriage and spaced from each other in the lateral direction. The protrusion bodies can pass through between the shutter bars so as to protrude toward the discharge position of the sheet products. The protrusion bodies are disposed and stood by above the sheet products when the sheet products are discharged and stacked on each other. The apparatus further comprises a first drive mounted on the carriage. After the sheet products are stacked, the protrusion bodies are lowered by the first drive so that the sheet products are nipped between the protrusion bodies and the feed conveyor. Then, coming sheet products are discharged without interruption and stacked on the protrusion bodies. The apparatus further comprises a second drive connected to the carriage. After the protrusion bodies are lowered, the second drive is operated in conjunction with the feed conveyor so that the carriage can be moved in the discharge direction of the sheet products so as to feed the sheet products nipped between the protrusion bodies and the feed conveyor. The apparatus further comprises a third drive by which the shutter bars are elevated and lowered for adjusting the height position thereof. When the sheet products are stacked and then fed, the lower ends of the shutter bars are disposed on a higher position than a top surface of the fed sheet products and on a lower position than an upper surface of the protrusion bodies. And then, when upstream ends of the sheet products arrive at or pass over the shutter bars, the lower ends of the shutter bars are lowered to a position corresponding to an upper surface of the feed conveyor or to a lower position than the upper surface of the feed conveyor. As a result, the coming sheet products are engaged with the shutter bars so as to be kept on and stood by while the sheet products are fed, and then the coming sheet products are lowered to the feed conveyor after the sheet products are fed.

In a preferred embodiment, after the sheet products are fed, the protrusion bodies are elevated by the first drive and the carriage are moved by the second drive. The protrusion bodies are returned to their original positions in such a manner that the sheet products are discharged and stacked below the protrusion bodies.

It is preferable that tip end portions of the protrusion bodies are protruded from upstream ends of the sheet products toward the upstream side when the sheet products are nipped between the protrusion bodies and the feed conveyor.

It is preferable that the feed conveyor comprises a receiving surface and a plurality of conveyor belts, the conveyor belts being spaced from each other in the lateral direction and disposed on the receiving surface, each of the shutter bars being disposed between each of the conveyor belts in the lateral direction, tip end portions of the shutter bars being lowered to the receiving surface when the upstream ends of the sheet products are moved to the downstream side from the shutter bars.

It is preferable that the apparatus further comprises recesses disposed on the receiving surface and at positions corresponding to the shutter bars respectively, the tip end portions of the shutter bars are lowered to a lower position than the receiving surface when the shutter bars are lowered.

DETAILED EXPLANATION OF THE PREFERRED EMBODIMENTS

An embodiment according to the present invention will be explained below.

Figure 1:
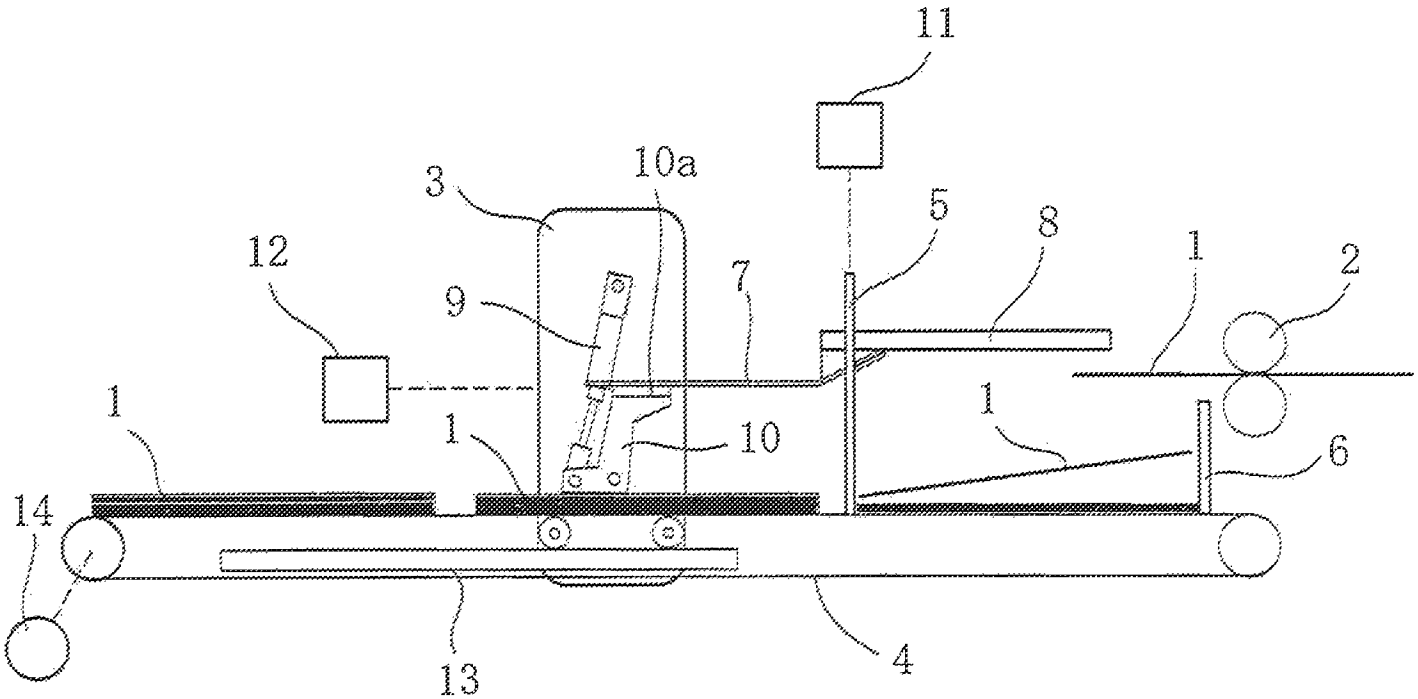
FIG. 1 is a side view showing an embodiment according to the invention.

FIG. 1 illustrates an apparatus for stacking and feeding sheet products discharged successively from a discharge position, according to the invention. The apparatus is configured to stack and feed plastic bags and incorporated into a machine for successively making plastic bags. The machine has the same structure as that of Patent Document 2 and comprises a heat blade. The plastic films are heat cut by the heat blade widthwise of the plastic films every time the plastic films are intermittently fed longitudinally thereof so as to make plastic bags 1. The plastic bags 1 are then discharged successively by stacker belts and clamp rollers 2. It should, therefore, be understood that sheet products are discharged successively and horizontally. The sheet product is composed of the plastic bag 1. The apparatus is used to stack and feed the plastic bags 1. The plastic bags 1 have a low stiffness to be flexible.

The apparatus comprises a carriage 3 spaced from the discharge position of the plastic bags 1 in a discharge direction of the plastic bags 1. The apparatus further comprises a plurality of shutter bars 5 disposed between the discharge position and the carriage 3 and above a feed conveyor 4. The discharge position corresponds to a position where the clamp rollers 2 are disposed. The feed conveyor 4 is composed of a belt conveyor having a predetermined length and extending in the discharge direction of the plastic bags 1. The shutter bars 5, on the other hand, are extended vertically and spaced from each other in the lateral direction. It should be understood that the lateral direction denotes a horizontal direction normal to the discharge direction of the plastic bags 1. When the plastic bags 1 are discharged, the plastic bags 1 collide against the shutter bars 5 so as to fall and stack on the feed conveyor 4. In this embodiment, the apparatus comprises a guide plate 6 opposed to the shutter bars 5 and disposed above the feed conveyor 4. The plastic bags 1 fall and stack on the feed conveyor 4 and between the shutter bars 5 and the guide plate 6.

The apparatus further comprises a plurality of protrusion bodies mounted on the carriage 3 and spaced from each other in the lateral direction. The protrusion bodies can pass through between the shutter bars 5 so as to protrude toward the discharge position of the plastic bags 1. The protrusion bodies are disposed and stood by above the plastic bags 1 when the plastic bags 1 are discharged and stacked on each other, in this embodiment, the protrusion bodies are composed of both press bars 7 and receiving members 8. The press bars 7 are composed of rigid members such as metal members. The receiving members 8 are composed of elastic members such as silicone rubber or silicone sponge members.

Figure 2:
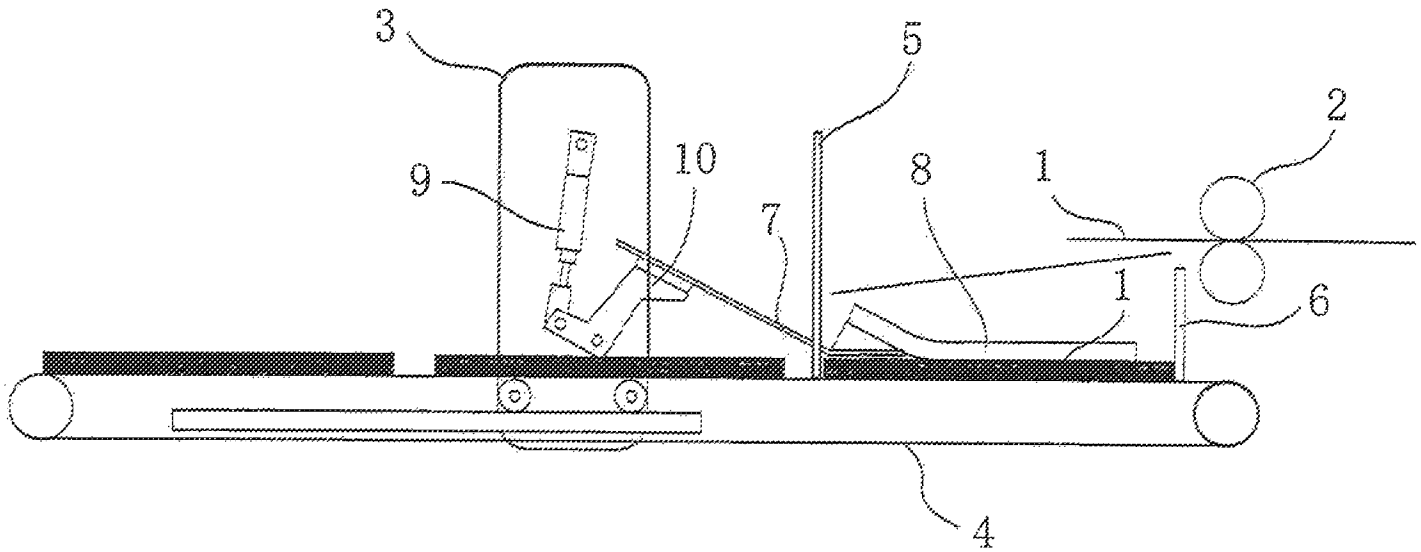
FIG. 2 is a side view showing a following process of an apparatus in FIG. 1.

The apparatus further comprises a first drive 9 mounted on the carriage 3. After the plastic bags 1 are stacked, as shown in FIG. 2, the protrusion bodies are lowered by the first drive 9 so that the protrusion bodies can engage with and press on the plastic bags 1. As a result, the plastic bags 1 are nipped between the protrusion bodies and the feed conveyor 4.

The protrusion bodies are lowered when a predetermined number of the plastic bags 1 are stacked on the feed conveyor 4. The protrusion bodies should be lowered between the discharged plastic bags 1 because the plastic bags 1 are discharged without cease while the protrusion bodies are lowered. Thus, the operation of the protrusion bodies requires high accuracy of control when the feed speed of the plastic bags 1 is fast. The timing of lowering the protrusion bodies can be controlled on 10 ms scale even with known technology. Therefore, it is possible to discharge the plastic bags 1 without cease, stack a predetermined number of the plastic bags 1 accurately and feed the stacked plastic bags 1 reliably even though the discharge speed of the plastic bags 1 is, for example, set to be 360 sheets discharged per minute, or the six bags are discharged in one second.

And then, the protrusion bodies can receive coming bags. The coming bags are discharged without interruption so as to fall and then stack on the protrusion bodies. The first drive 9, for example, is composed of an air cylinder or a hydraulic cylinder. The protrusion bodies are lowered by the first drive 9 such as an air cylinder or a hydraulic cylinder.

In this embodiment, the apparatus further comprises arms 10 mounted on the carriage 3. The protrusion bodies are fixed on the arms 10. The arms 10 are swung by the first drive 9 so that the protrusion bodies can be revolved to be lowered. As described above, the protrusion bodies are composed of both the press bars 7 and the receiving members 8. The press bars 7 are fixed on the arms 10, while the receiving members 8 are fixed on the press bars 7. For example, a base plate 10*a* is disposed between a pair of the arms 10. The base plate 10*a* is fixed on an upper end of each of the arms 10. Each of the press bars 7 having the receiving members 8 is fixed on base plate 10*a*. The arms 10 are connected to the press bars 7 via the base plate 10*a*. Thus, both the press bars 7 and the receiving members 8 are revolved to be lowered by the first drive 9. Tip end portions of the press bars 7 can engage with and press on the plastic bags 1 when the press bars 7 are lowered. The tip end portions of the press bars 7 may be bent appropriately so as to engage with the plastic bags 1 so that the bent portions of the press bars 7 can press on the plastic bags 1. The front end portions of the plastic bags 1 are nipped between the press bars 7 and the feed conveyor 4.

The plastic bags 1 are engaged with and pressed by the press bars 7. On the other hand, the receiving members 8 are composed of elastic members such as silicone rubber or silicone sponge. Thus, when the press bars 7 are engaged with the plastic bags 1, the receiving members 8 are elastically deformed along the plastic bags 1 so as to engage with the upper surface of the plastic bags 1. And then, the receiving members 8 can receive coming bags 1. The coming bags 1 are discharged without interruption so as to fall and then stack on the receiving members 8.

The press bars 7 may be connected to the receiving members 8 via elastic members by which the receiving members 8 can be bent and arranged along the plastic bags 1 so as to engage with the upper surface of the plastic bags 1. In this case, the receiving members 8 may be composed of rigid members.

Figure 3:
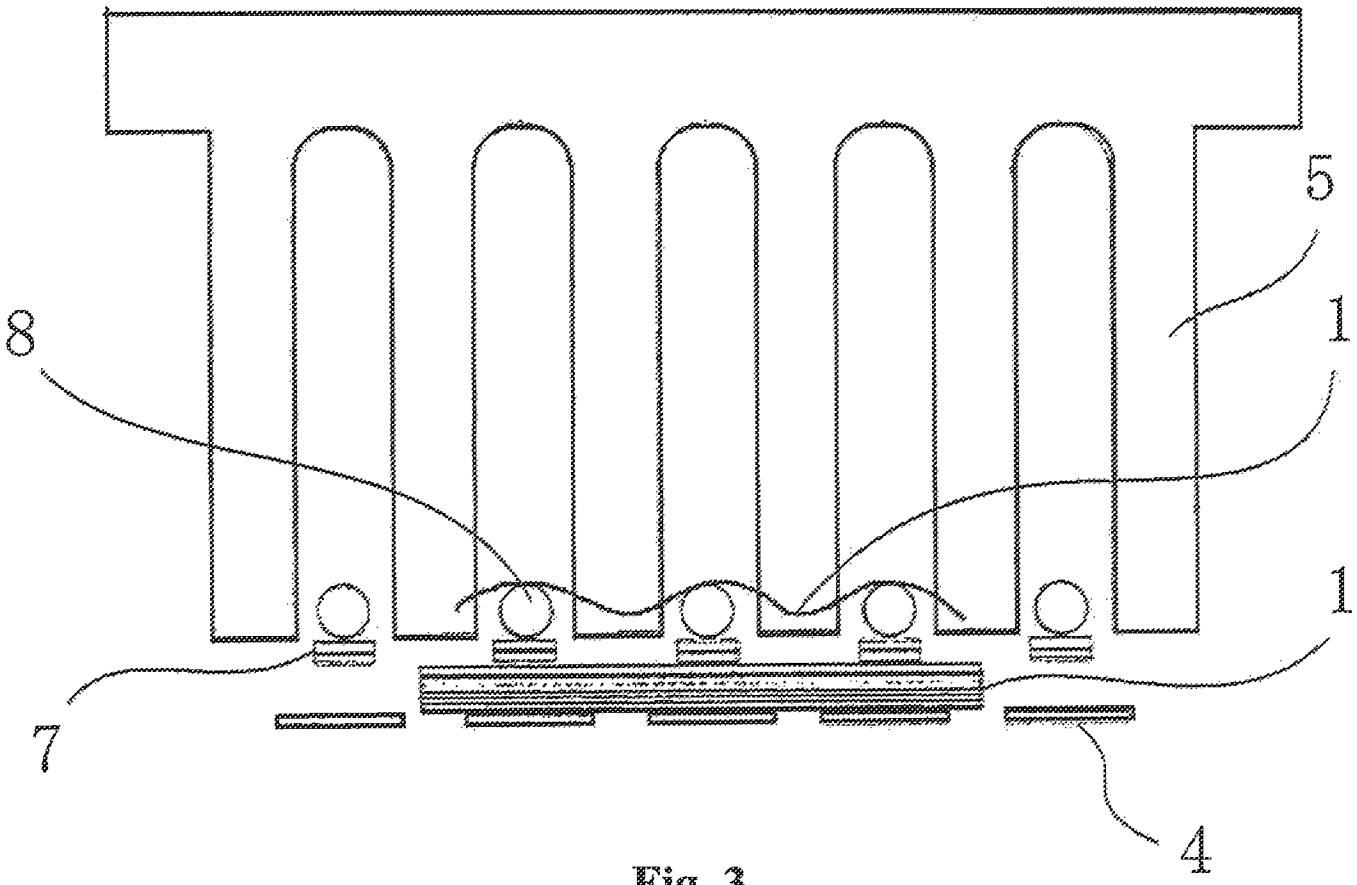
FIG. 3 is a front view showing a relationship between receiving members in FIG. 2 and coming plastic bags.

As shown in FIG. 3, when the receiving members 8 receive the coming bag 1, a sectional shape normal to the discharge direction of the coming bag 1 becomes a curved line to get a stiffness. As a result, the coming bags 1 can be stacked on the receiving members 8 without wrinkle even though the coming bags 1 collide against the shutter bars 5 after being discharged from the cramp rollers 2. The shutter bars 5 are designed as a comb.

Figure 4:
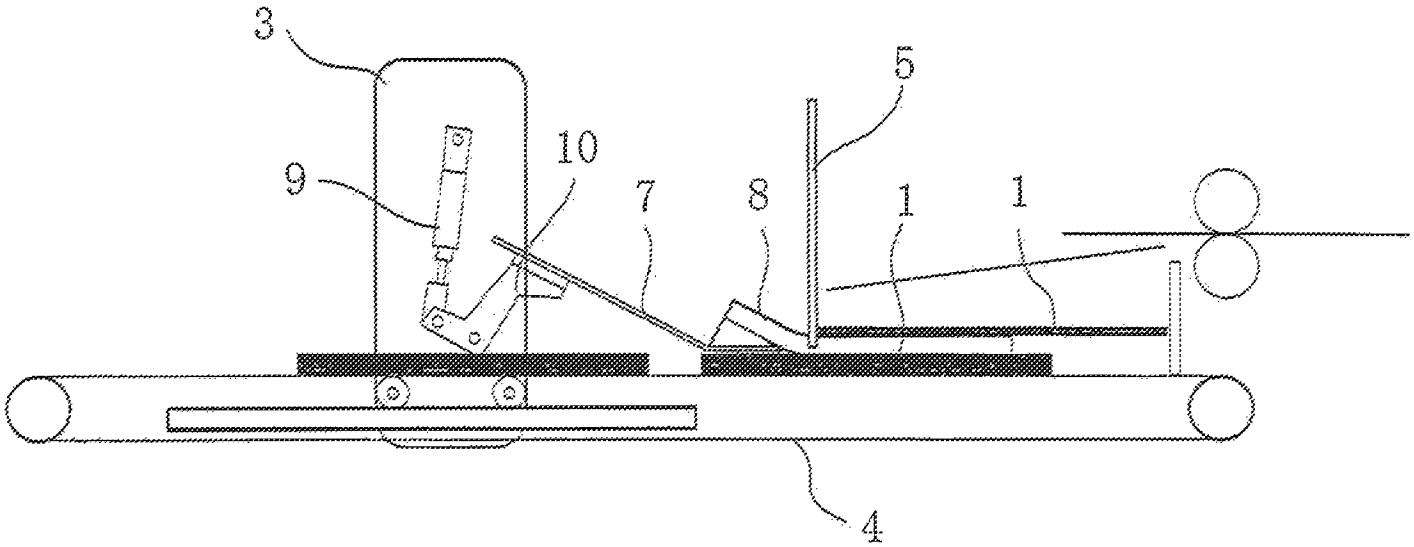
FIG. 4 is a side view showing a following process of the apparatus in FIG. 2.

The apparatus further comprises a shutter drive 11 connected to the shutter bars 5 (FIG. 1). As shown in FIG. 4, the shutter bars 5 are elevated by the shutter drive 11 after the protrusion bodies are lowered. The distance of the elevation of the shutter bars 5 corresponds to the height of the stacked plastic bags 1. For example, the shutter drive 11 is composed of an air cylinder or a hydraulic cylinder. The shutter bars 5 are elevated by the air cylinder or the hydraulic cylinder.

Figure 5:
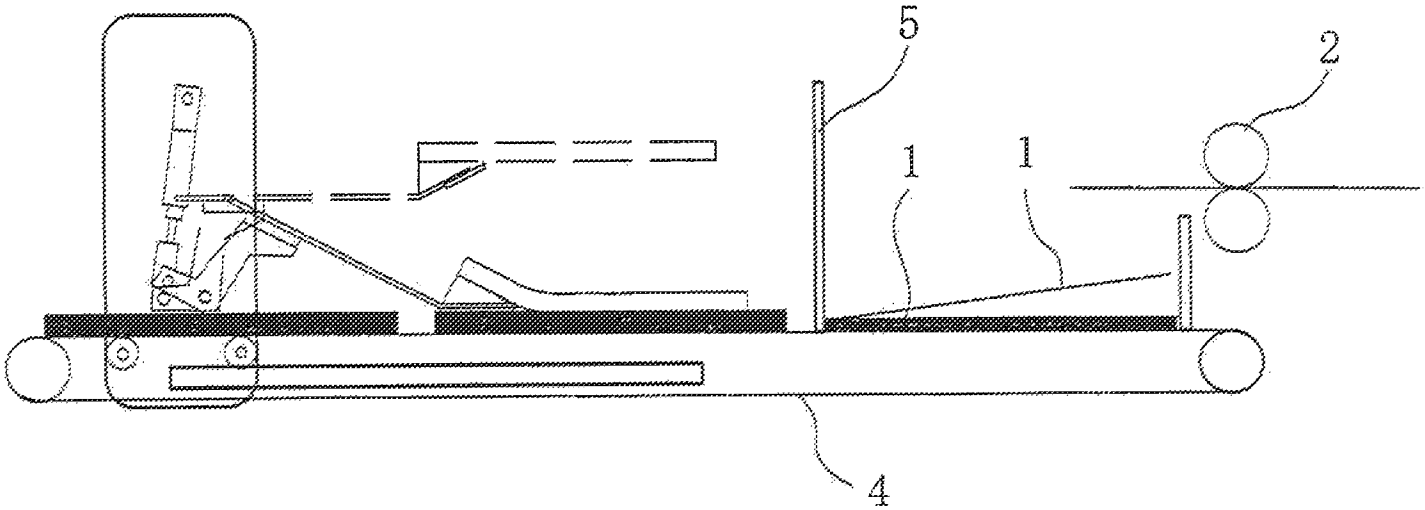
FIG. 5 is a side view showing a following process of the apparatus in FIG. 4.

The apparatus further comprises a second drive 12 connected to the carriage 3 (FIG. 1). As described above, the shutter bars 5 are elevated after the protrusion bodies are lowered. And then, the second drive 12 is operated in conjunction with the feed conveyor 4 so that the carriage 3 can be moved in the discharge direction of the plastic bags 1 so as to feed the plastic bags 1 nipped between the protrusion bodies and the feed conveyor 4 (FIG. 5). For example, the second drive 12 is also composed of an air cylinder or a hydraulic cylinder. The carriage 3 is moved by the air cylinder or the hydraulic cylinder. The carriage 3 is guided by and moved along a guide rail 13 (FIG. 1). The guide rail 13 extends in the discharge direction of the plastic bags 1 so that the carriage 3 can move in the discharge direction of the plastic bags 1. Thus, the protrusion bodies along with the carriage 3 are moved between the shutter bars 5. In this embodiment, both the press bars 7 and the receiving members 8 are moved along with the carriage 3.

The carriage 3 is moved, and at the same time the feed conveyor 4 is driven in the moving direction of the carriage 3. As a result, the plastic bags 1 are fed by both the protrusion bodies and the feed conveyor 4, while the coming bags 1 are engaged with the shutter bars 5 so as to be kept on and stood by the position. For example, the feed conveyor 4 is driven by a drive motor 14 (FIG. 1). The plastic bags 1 to be fed are nipped between the protrusion bodies and the feed conveyor 4. The shutter drive 11 is used as a third drive by which the shutter bars 5 are elevated and lowered for adjusting the height position thereof. When the plastic bags 1 are stacked and then fed, the lower ends of the shutter bars 5 are disposed on a higher position than a top surface of the fed plastic bags 1 and on a lower position than an upper surface of the protrusion bodies. And then, when upstream ends of the plastic bags 1 arrive at or pass over the shutter bars 5, the lower ends of the shutter bars 5 are lowered to a position corresponding to an upper surface of the feed conveyor 4 or to a lower position than the upper surface of the feed conveyor 4.

As shown in FIG. 3, the top surface of the plastic bags 1 nipped between the protrusion bodies and the feed conveyor 4 is disposed on a lower position than the lower ends of the shutter bars 5. Therefore, the nipped plastic bags 1 can be fed to a downstream side of the moving direction from the shutter bars 5 (FIG. 4). On the other hand, as shown in FIG. 3, a bottom surface of the plastic bags 1 stacked on the receiving members 8 is disposed on a higher position than the lower ends of the shutter bars 5. Therefore, the plastic bags 1 stacked on the receiving members 8 are hold by the shutter bars 5 so as to be kept on an upstream side of the moving direction from the shutter bars 5 (FIG. 4).

The shutter bars 5 are lowered when the upstream ends of the plastic bags 1 nipped between the protrusion bodies and the feed conveyor 4 are fed to the downstream side than the shutter bars 5 (FIG. 5). During a series of the operations, at first upstream ends of the plastic bags 1 stacked on the receiving members 8 fall onto the feed conveyor 4, and then downstream ends thereof fall onto the feed conveyor 4. The sectional shape of the plastic bags 1, as shown in FIG. 3, is a curved line. Therefore, the plastic bags 1 fall slowly so that the bottom surface thereof cannot be disposed on a lower position than the lowest ends of the shutter bars 5. That is to say, the plastic bags 1 can be kept on an upstream position of the moving direction from the shutter bars 5 when the shutter bars 5 are lowered to the lowest position. The following plastic bags 1 can be discharged from the cramp rollers 2 without cease so as to stack on the plastic bags 1 kept on an upstream position of the moving direction from the shutter bars 5 successively.

Figure 6:
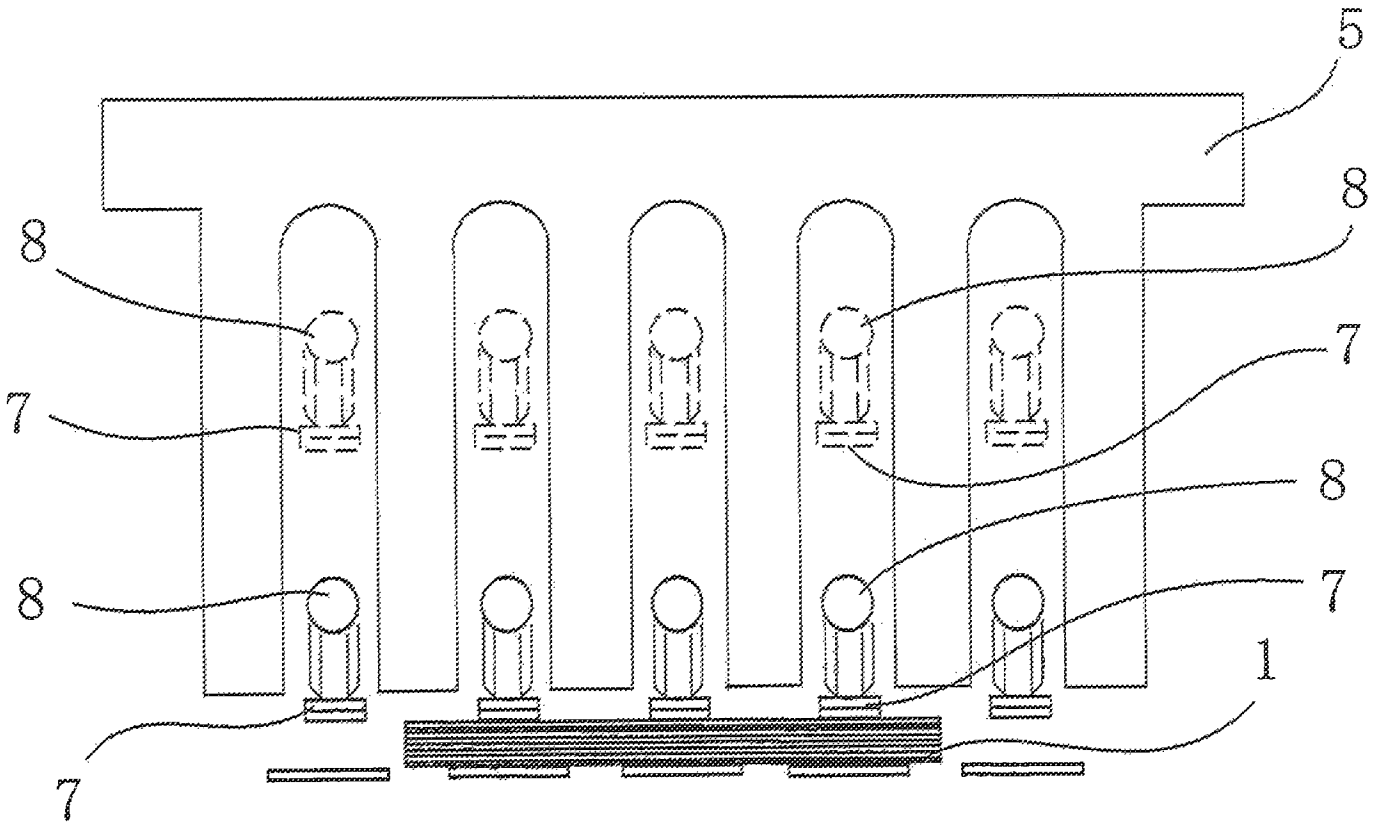
FIG. 6 is a back view showing a relationship between shutter bars, press bars and the receiving members in FIG. 2.

After the plastic bags 1 are fed to the downstream side from the shutter bars 5, as shown in FIGS. 5 and 6, the protrusion bodies are elevated by the first drive 9. And then, the carriage 3 is moved by the second drive 12 and the protrusion bodies are returned to their original position so that the plastic bags 1 can be discharged and stacked below the protrusion bodies (FIG. 1). In this embodiment, the press bars 7 and the receiving members 8 are elevated by the first drive 9. And then, the carriage 3 is moved by the second drive 12 so that the protrusion bodies can be returned to the position in FIG. 1. As a result, when the plastic bags 1 are discharged, the protrusion bodies are disposed above the plastic bags 1.

Therefore, after that, the plastic bags 1 are stacked again. After stacked, the above processes are performed repeatedly and the plastic bags 1 are fed again. Therefore, a predetermined number of the plastic bags 1 are stacked and then fed.

In case of this machine, the plastic bags 1 are pressed by the protrusion bodies after being stacked, and then the plastic bags 1 are nipped between the protrusion bodies and the feed conveyor 4 so as to be fed. Therefore, unlike the machine of Patent Document 1, there is no problem in the plastic bags 1 with flexibility and low stiffness. The machine can stack and feed the plastic bags 1 reliably even though the plastic bags 1 have a low stiffness. Thus, the plastic bags 1 are not out of alignment to slide and collapse while being stacked and then fed.

Figure 7B:
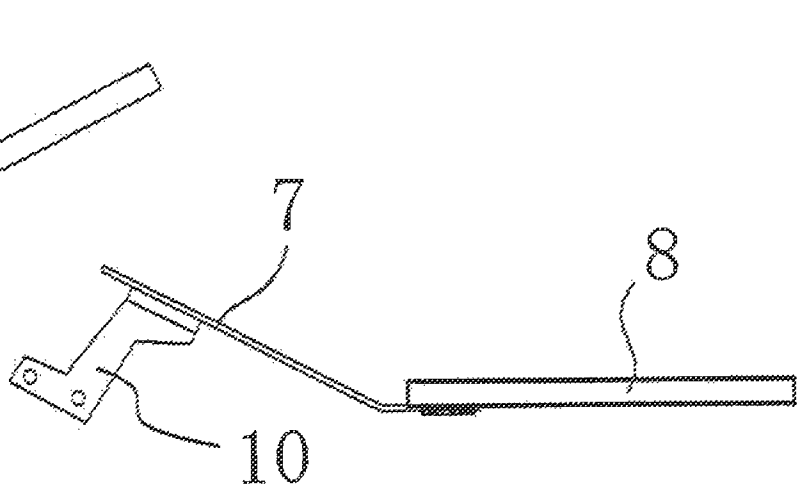
FIG. 7B is an explanatory view showing the embodiment in FIG. 7A wherein the press bars and receiving members are lowered.
Figure 7A:
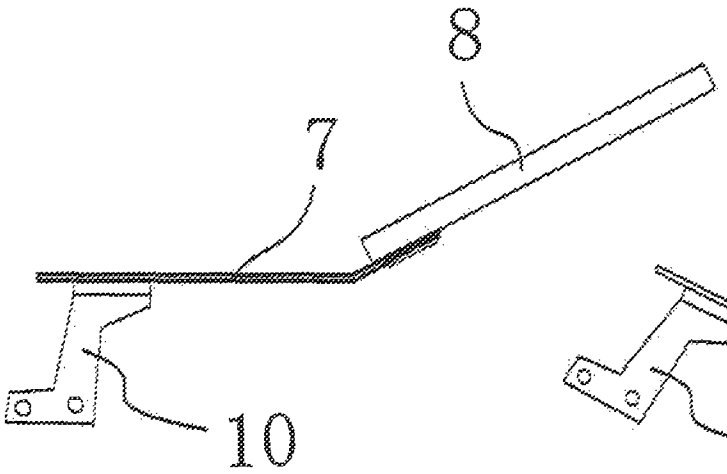
FIG. 7A is an explanatory view showing other embodiment.

Though, in case of other embodiment, the receiving members 8 may not be composed of elastic members but rigid members such as Teflon (Registered Trade Mark) or carbon pipe. In this case, as shown in FIG. 7, the tip ends of the receiving members 8 are disposed on a high position when being elevated by the arms 10. Thus, the shutter bars 5 should be long so that the upper ends thereof can be disposed on a high position.

Figures 8A, 8B:
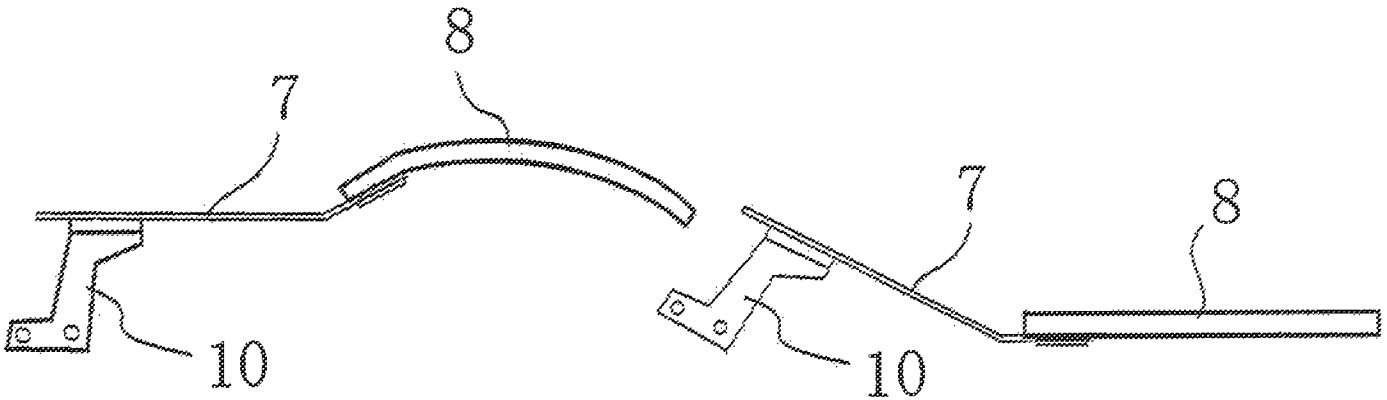
FIG. 8A is an explanatory view showing other embodiment.
FIG. 8B is an explanatory view showing the embodiment in FIG. 8A wherein the press bars and the receiving members are lowered.

As shown in FIG. 8, the receiving member 8 may be composed of elastic member such as silicone rubber or silicone sponge member so as to be curved when being elevated so that the tip ends thereof can be disposed on a low position. The receiving member 8 may be curved by their own weight or by the weight attached to the tip ends thereof.

Figure 18:
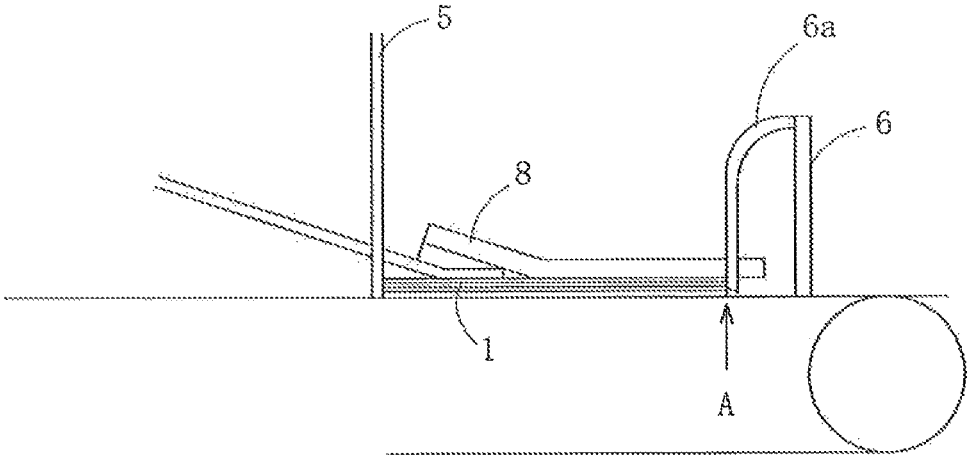
FIG. 18 is a side view showing a guide plate of other embodiment.
Figure 19:
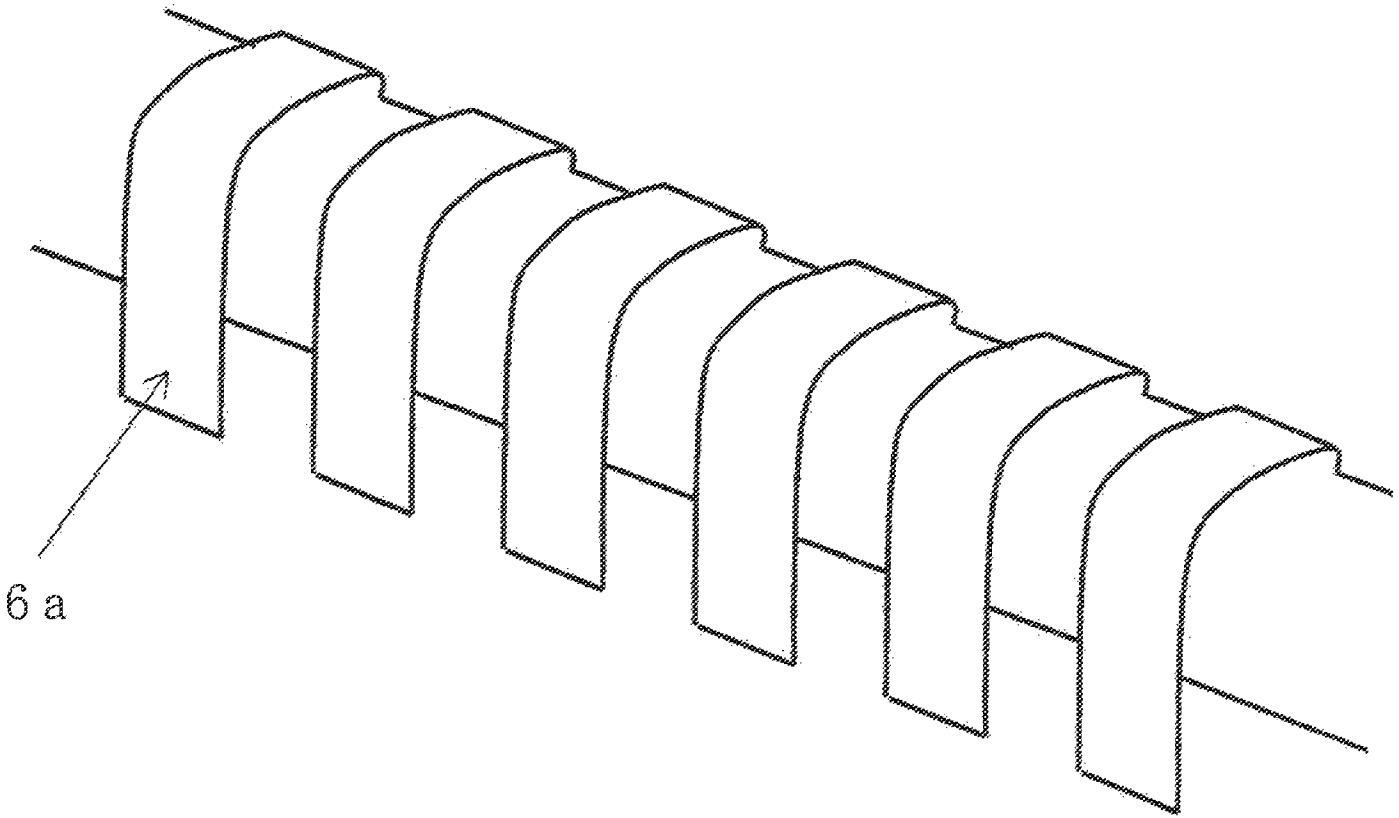
FIG. 19 is a perspective view showing the guide plate of other embodiment.

In case of other embodiment, the guide plate 6 may be shaped as shown in FIGS. 18 and 19, whereby the plastic bags 1 stacked on the receiving members 8 can be hold on an upstream position from the shutter bars 5, or cannot slip under the shutter bars 5 when the plastic bags 1 nipped between the protrusion bodies and the feed conveyor 4 are fed to the downstream side from and under the shutter bars 5.

That is to say, a plurality of arched guide bars 6*a* is mounted on the guide plate 6 and faces the downstream side thereof. As shown in FIG. 6 wherein the shutter bars 5 are viewed from the discharge direction, each of the guide bars 6*a* is respectively disposed on the position corresponding to each of the shutter bars 5. Thus, the protrusion body (the receiving member 8) can pass through space between each of the guide bars 6*a*, as shown in FIG. 18.

As a result, the plastic bags 1 are discharged from the clamp rollers 2 and slipped through on the guide bars 6*a* so that downstream ends of the plastic bags 1 can collide against the shutter bars 5 while upstream ends of the plastic bags 1 can hill on the downstream side from the guide bars 6*a*. Therefore, the upstream ends of the plastic bags 1 cannot be disposed on the upstream side from point A in FIG. 18. On the other hand, the tip end portion of the receiving member 8 can pass through the space between each of the guide bars 6*a* so as to reach the upstream side from point A in FIG. 18.

That is to say, the tip end portions of the receiving members 8 are disposed on the upstream side from the upstream ends of the plastic bags 1 nipped between the protrusion bodies (the receiving members 8) and the feed conveyor 4. Therefore, when the nipped plastic bags 1 are fed to the downstream side from the shutter bars 5, the tip end portions of the receiving members 8 on which the plastic bags 1 are stacked are still disposed on the upstream side from the shutter bars 5 when the upstream ends of the plastic bags 1 are moved to the downstream side from the shutter bars 5. At the same time, the shutter bars 5 are lowered so as to completely keep the plastic bags 1 stacked on the receiving members 8 from sliding under the shutter bars 5 and moving to the downstream side therefrom.

Depending on the size of the plastic bag 1, a distance between the shutter bars 5 and the guide plate 6 can be adapted, and in addition, a relative position between the press bars 7 and the receiving members 8 in the moving direction can be adapted using elongate holes as connecting means.

Figure 9:
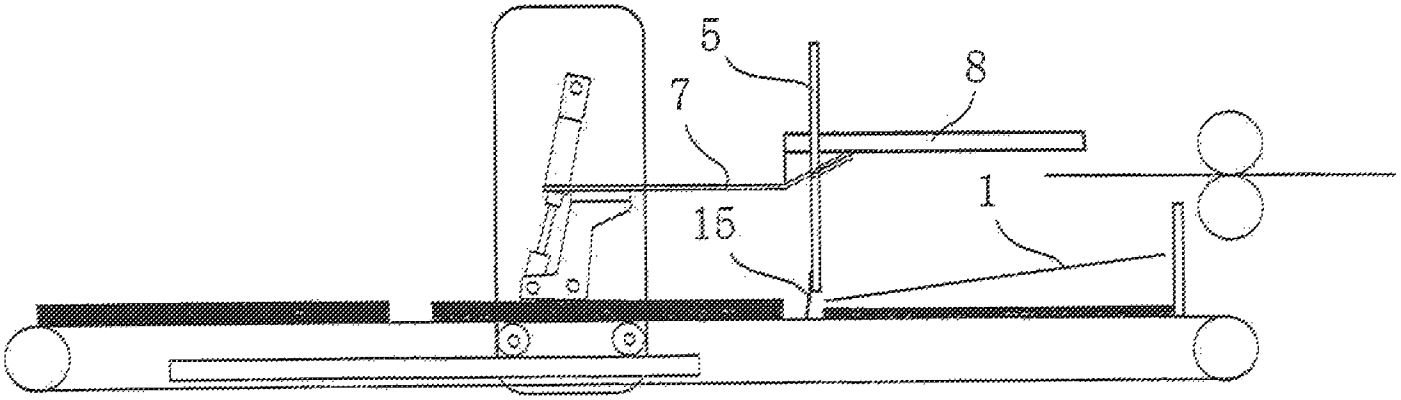
FIG. 9 is a side view showing other embodiment.
Figure 10:
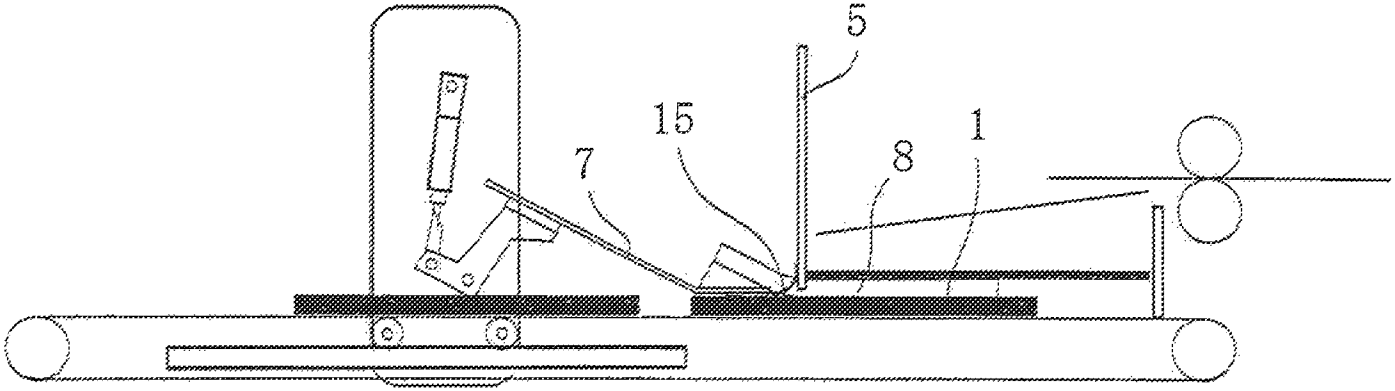
FIG. 10 is a side view showing the embodiment in FIG. 9 wherein plastic bags are fed.

FIG. 9 shows other embodiment. In this embodiment, the shutter bars 5 are spaced from the feed conveyor 4. Additional members 15 are disposed on the lower ends of the shutter bars 5 respectively. The additional members 15 are flexible and hanged from the shutter bars 5. The plastic bags 1 are guided by the additional members 15 so as to fall and stack on the feed conveyor 4. As shown in FIG. 10, the additional members 15 are pressed and bent by the plastic bags 1 fed by both the protrusion bodies and the feed conveyor 4 so that the plastic bags 1 can be passed and fed through between the shutter bars 5 and the feed conveyor 4. In this case, the shutter bars 5 need not be elevated and lowered.

Figure 11:
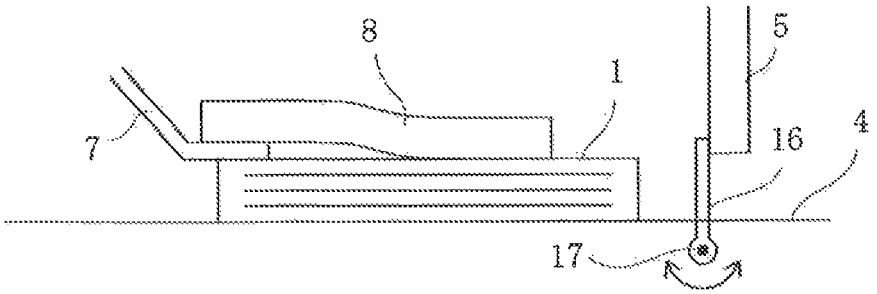
FIG. 11 is a side view showing other embodiment.

In other embodiment in FIG. 11, the feed conveyor 4 is composed of a belt conveyor having a plurality of belts. Arms 16 are protruded from between each of the belts and supported on shaft 17 below the belts. The arms 16 are rotatable around the shaft 17 and pressed by springs. Each of the arms 16 is passed through between each of the belts and extended vertically so as to engage with the shutter bars 5. The plastic bags 1 are guided by the arms 16 so as to fall and stack on the feed conveyor 4. The arms 16 are pressed and swung by the plastic bags 1 fed by both the protrusion bodies and the feed conveyor 4 so that the plastic bags 1 can be passed and fed through between the shutter bars 5 and the feed conveyor 4.

Figure 12A:
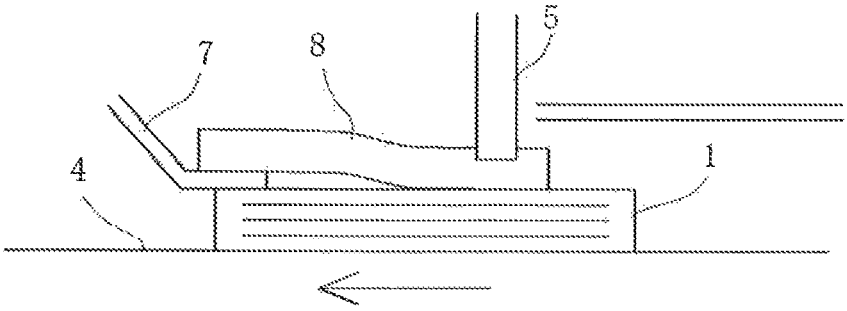
FIG. 12A is a side view showing other embodiment.
Figure 12B:
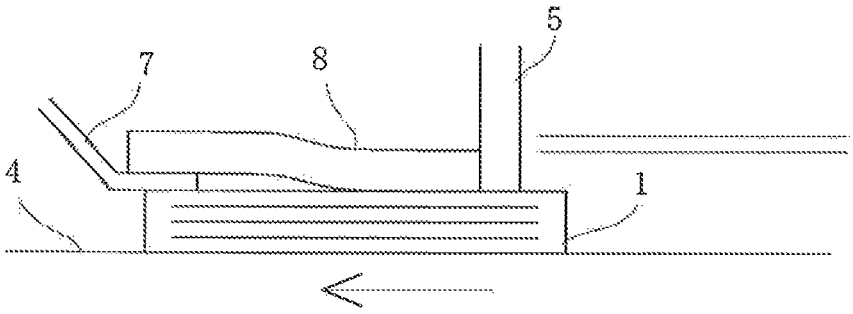
FIG. 12B is a side view showing a following process in FIG. 12A.
Figure 12C:
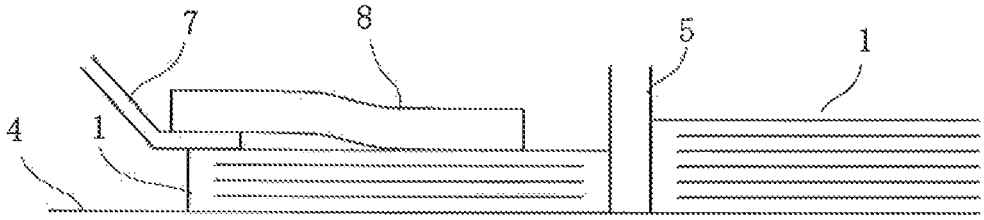
FIG. 12C is a side view showing a following process in FIG. 12B.

As shown in FIG. 12, in case that the plastic bags 1 are longer than the receiving members 8, when the plastic bags 1 to be fed are nipped between the press bars 7 and the feed conveyor 4, the shutter bars 5 are elevated by the shutter drive 11 (FIG. 12A) in the same way as the embodiment in FIG. 1. And then, shortly after or before the receiving members 8 pass over the shutter bars 5, the shutter bars 5 may be lowered by the shutter drive 11 so that the tip end portions thereof can engage with and press on the plastic bags 1 (FIG. 12B). When the plastic bags 1 are fed, the coming plastic bags 1 are blocked by the shutter bars 5. Thus, the coming plastic bags 1 keep from drawing into the plastic bags 1 even though the plastic bags 1 are fed. And then, the shutter bars 5 are lowered to their original position (FIG. 12C). Therefore, the plastic bags 1 fall and stack on the feed conveyor 4.

Figure 13A:
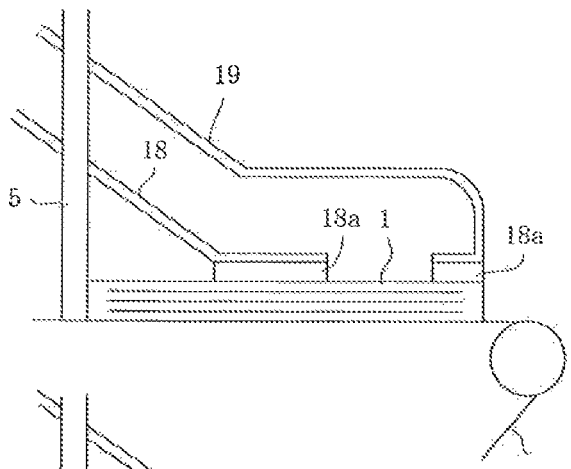
FIG. 13A is a side view showing other embodiment.
Figure 13B:
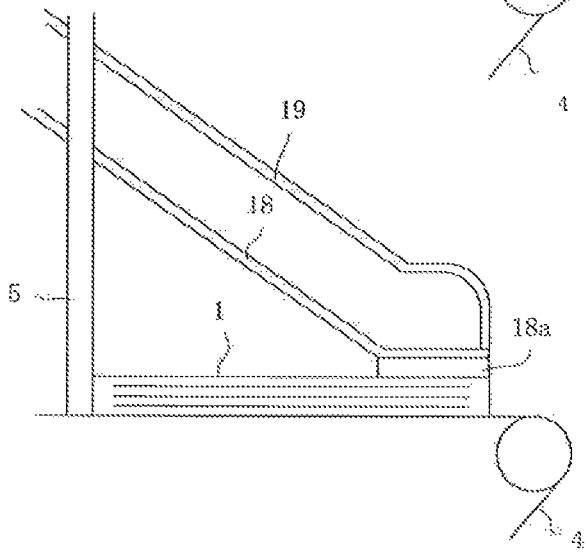
FIG. 13B is a side view showing other embodiment.

In the embodiment in FIG. 13, the protrusion bodies are composed of both press bars 18 and the receiving members 19. The press bars 18 are composed of rigid members, such as metal members, and have a plate shape. The receiving members 19 are fixed on the press bars 18. The press bars 18 engage with and press on the plastic bags 1 at the tip end portions of the press bars 18. The tip end portions of the press bars 18 may be bent appropriately so that the bent portions can engage with and press on the plastic bags 1. The position to be pressed may be disposed on a center position (FIG. 13A) or back end portion (FIG. 13B) of the plastic bags 1 longitudinally thereof. Additional members 18*a* may be attached on the press bars 18 respectively at the bent portions thereof so that both the press bars 18 and additional members 18*a* can engage with and press on the plastic bags 1. The additional members 18*a* are composed of elastic members such as silicone rubbers and silicone sponges. In this case, non-slip and cushion effects are achieved by the additional members 18*a*.

On the other hand, the receiving members 19 are composed of metal plates but have elasticity. In this case, for example, the receiving members 19 engage with the back end portion of the plastic bags 1. And then, the receiving members 19 may be elastically deformed so as to engage with the center portion of the plastic bags longitudinally thereof (FIG. 13A). The receiving members 19 may be bent appropriately at the tip end portions of the receiving members 19 respectively so that the bent portions thereof can engage with the plastic bags 1. The additional members 18*a* nay be attached on the receiving members 19 respectively at the bent portions of the receiving members 19 so that both the receiving members 19 and additional members 18*a* can engage with the plastic bags 1. The press bars 18 may engage with the back end portion of the plastic bags 1, and the receiving members 19 are aligned to the press bars 18 at the tip end portions of both the press bars 18 and the receiving members 19 (FIG. 13B). The receiving members 19 may be configured to cooperate with the press bars 18.

Figure 13C:
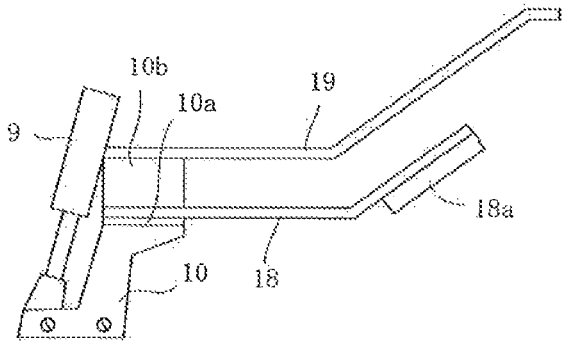
FIG. 13C is a side view showing other embodiment.

The receiving members 19 may not be bent, and the additional members 18*a* may not be attached, and in addition the receiving members 19 can move toward and engage with the plastic bags 1 at the tip end portions of the receiving members 19 (FIG. 13C). Both the press bars 1 and the receiving members 19 may be fixed on the arms 10. For example, the press bars 18 are fixed on a base plate 10*a* in the same way as the embodiment in FIG. 1. Furthermore, a spacer 10*b* may be disposed between the receiving members 19 and the press members 18, and the receiving members 19, spacer 10*b*, press bars 18 and the base plate 10*a* may be fixed on the arms 10.

As a result, the plastic bags 1 are pressed by the press bars 18 so as to be nipped between the press bars 18 and the feed conveyor 4. And then, the receiving members 19 receive the coming plastic bags 1 in the same way as the embodiment in FIG. 1.

Figure 14A:
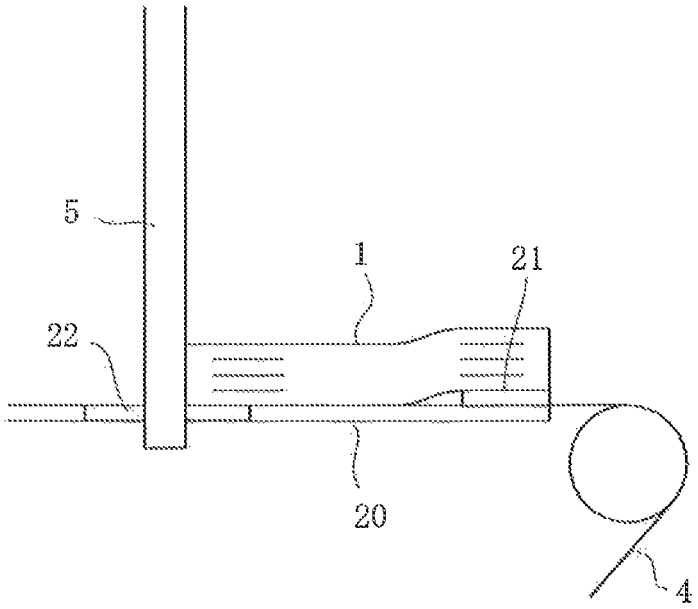
FIG. 14A is a side view showing other embodiment.
Figure 14B:
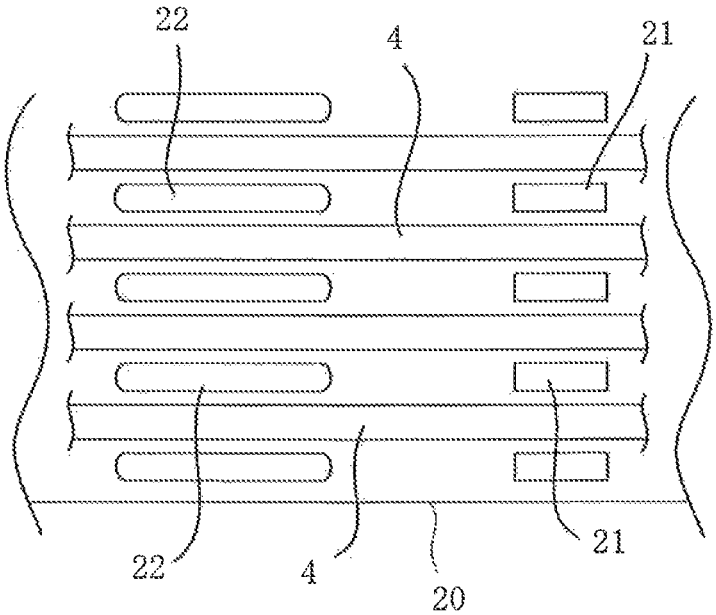
FIG. 14B is a top view showing a feed conveyor in FIG. 14A.

In other embodiment in FIG. 14, the feed conveyor 4 is composed of a belt conveyor having a plurality of belts. Furthermore, a receiving plate (a receiving surface) 20 is disposed below the belts. A plurality of projection portions 21 is disposed on the receiving plate 20 so as to pass through between and project upward from each of the belts. Consequently, when the stacked plastic bags 1 are fed by the feed conveyor 4 in such a manner that the coming plastic bags 1 can fall and stack on the feed conveyor 4, the coming plastic bags 1 are engaged with the projection portions 21 and supported above the belts at the back end portion of the coming bags 1 so as to keep from drawing into the belts.

Figure 20:
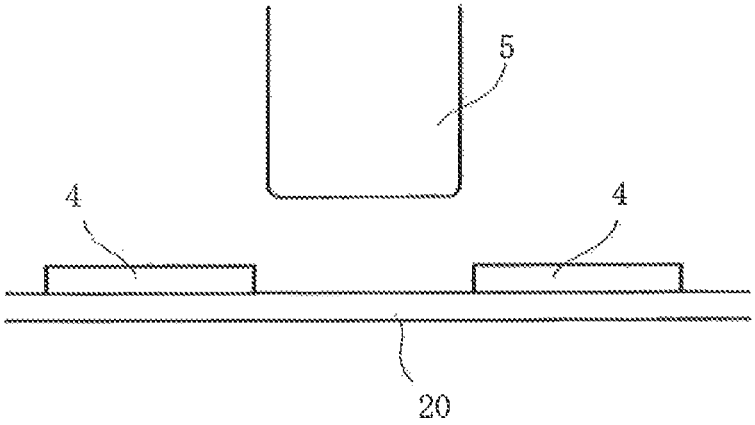
FIG. 20 is a front view showing a relationship between the shutter bars and the feed conveyor of other embodiment.

In other embodiment in FIG. 20, the feed conveyor 4 comprises a plurality of belts in the same way as the embodiment in FIG. 14, while the shutter bars 5 have the tip end portions smaller than spaces between each of the belts of the feed conveyor 4 widthwise. Thus, when the shutter bars 5 are lowered, the tip end portions thereof pass through the upper surface of the belts of the feed conveyor 4 so as to move downward to a position adjacent the upper surface (the receiving surface) of the receiving plate 20. According to this structure, the tip end portions of the shutter bars 5 can be lowered from the lowest surface of the plastic bags 1 stacked on the feed conveyor 4 so as to keep the stacked plastic bags 1 from drawing into the downstream side from the shutter bars 5 even if, when the plastic bags 1 are fed toward the downstream side from the shutter bars 5, the shutter bars 5 are lowered when the upstream ends of the plastic bags 1 are moved to the downstream side from the shutter bars 5.

A plurality of slots 22 may be formed in the receiving plate (the receiving surface) 20 so that the shutter bars 5 can pass through between each of the belts so as to insert into the slots 22 when the shutter bars 5 are lowered. In this case, the plastic bags 1 are blocked by the shutter bars 5 so as not to pass and move through between the belts and the shutter bars 5.

According to further other embodiment, the receiving plate (the receiving surface) 20 may be provided with recesses instead of the slots 22.

Figure 15A:
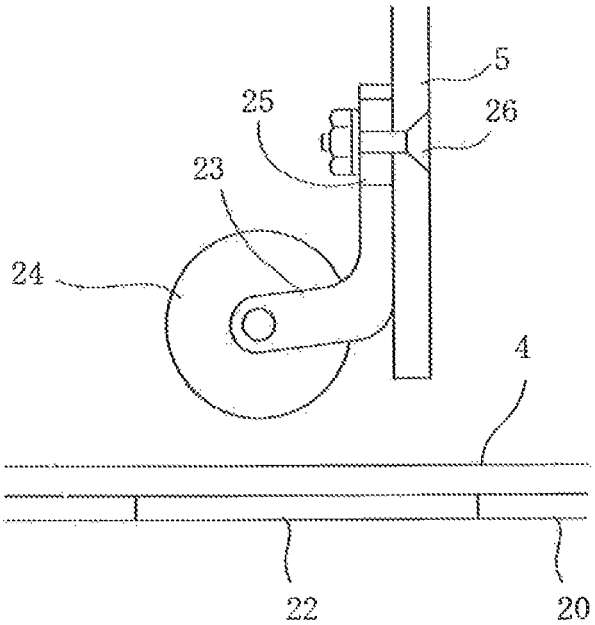
FIG. 15A is a side view showing other embodiment.
Figure 15B:
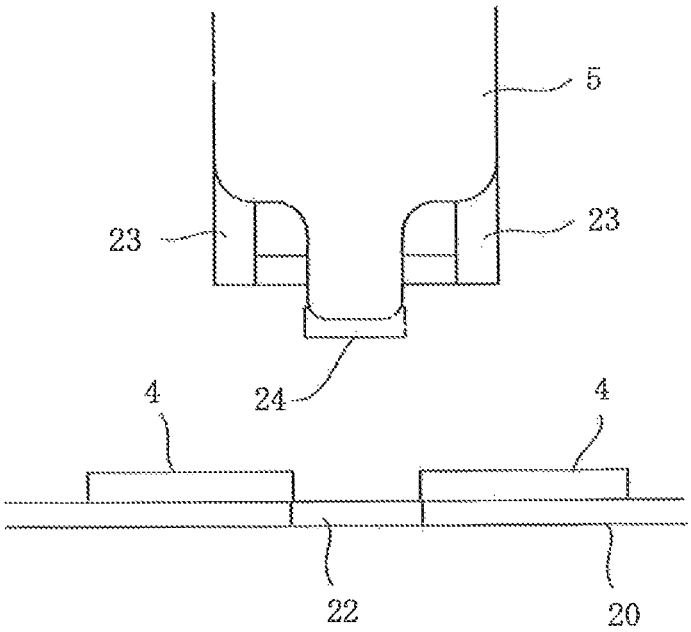
FIG. 15B is a front view showing the shutter bars and the feed conveyor in FIG. 15A.

In other embodiment in FIG. 15, each of the shutter bars 5 has a bracket 23 for supporting a roller 24. The lower end portions of the rollers 24 are disposed below the shutter bars 5 (FIG. 15A). In case of the embodiment in FIG. 12, when the shutter bars 5 are lowered by the shutter drive 11 (FIG. 12), the plastic bags 1 are engaged with and pressed by the rollers 24 rather than the tip end portions of the shutter bars 5. Thus, the rollers 24 are rotated by friction so as to guide the plastic bags 1. The plastic bags 1 are not damaged because the shutter bars 5 cannot engage with them. As shown in FIG. 15, the bracket 23 is provided with a slot 25 through which a screw 26 passes. The height positions of both the bracket 23 and the roller 24 can be adapted by the slot 25 when the bracket 23 is attached on the shutter bars 5 via the screw 26.

And then, the shutter bars 5 are lowered to their original position (FIG. 12C). The plastic bags 1 are stacked on the feed conveyor 4 having the belts. Furthermore, the lower end portions of the shutter bars 5 are narrowed widthwise (FIG. 15B) so that both the narrowed portions and the rollers 24 can insert into the slot 22 when the shutter bars 5 are lowered. Consequently, the plastic bags 1 are blocked by the shutter bars 5.

Figure 16A:
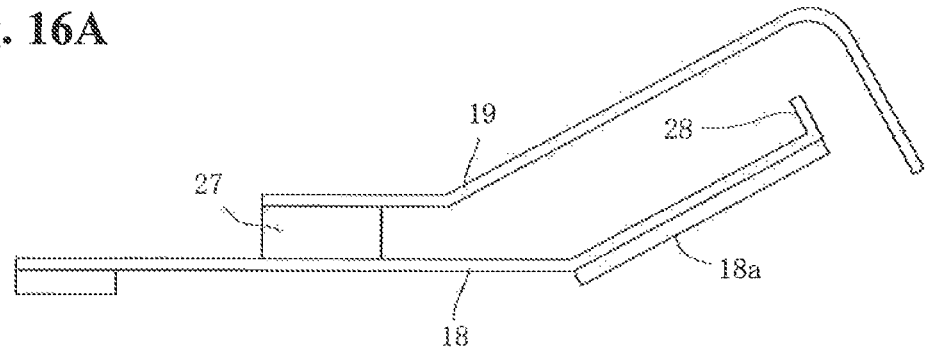
FIG. 16A is a side view showing other embodiment.
Figure 16B:
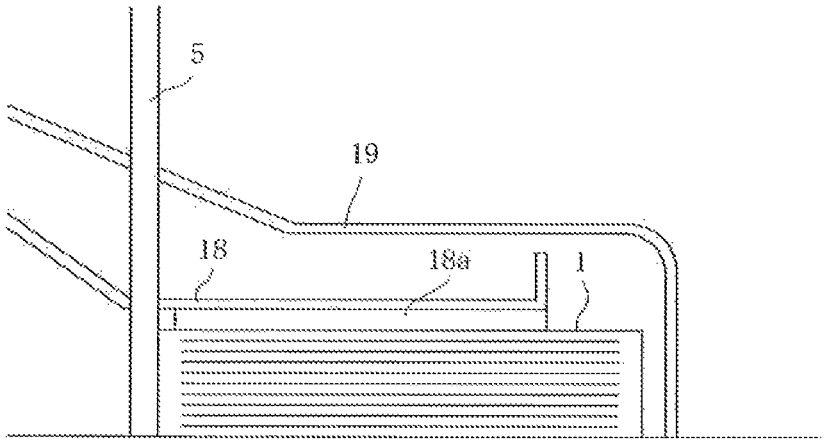
FIG. 16B is a side view showing the embodiment in FIG. 16A wherein the press bars and the receiving members are lowered.

In other embodiment in FIG. 16, both the press bars 18 and the receiving members 19 are fixed with each other via the spacer 27. The press bars 18 are provided with the additional members 18*a*. The receiving members 19 are curved or bent downward beyond the tip end portions of the press bars 18 (FIG. 16A). After the press bars 18 and the receiving members 19 are lowered, at first the receiving members 19 engage with and press on the feed conveyor 4, and then the receiving members 19 are elastically deformed and the press bars 18 engage with and press on the plastic bags 1 (FIG. 16B). And then, the receiving members 19 receive the coming plastic bags 1. Thus, the coming bags 1 are blocked by the receiving members 19 when the plastic bags 1 are fed.

Figure 16C:
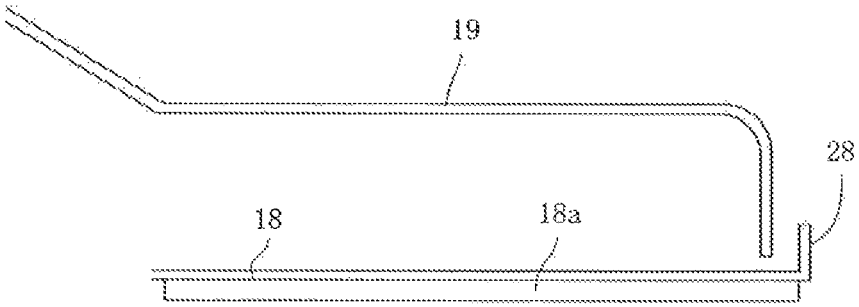
FIG. 16C is a side view showing other embodiment.

Conversely, the press bars 18 may be curved or bent upward beyond the tip end portions of the receiving members 19 (FIG. 16C). The corning plastic bags 1 may be blocked by the curved or bent portions 28.

Figure 17:
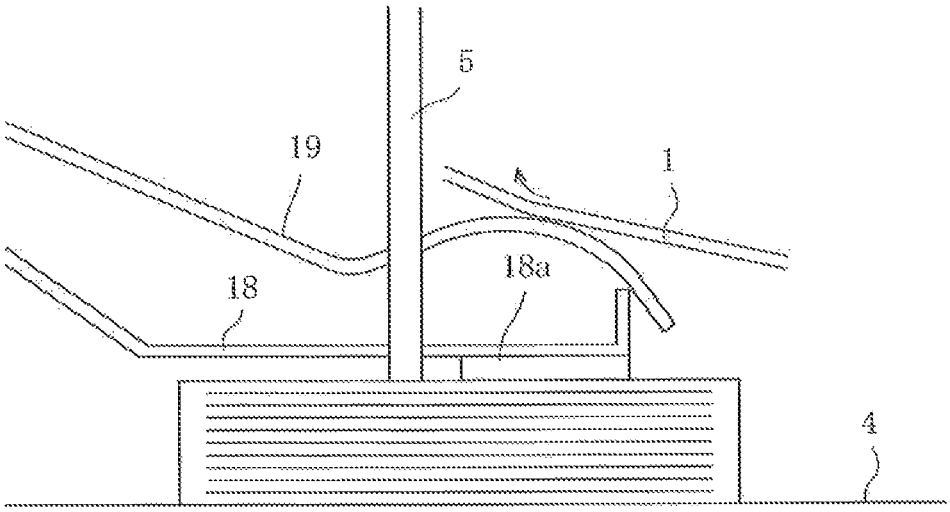
FIG. 17 is a side view showing other embodiment.

As shown in FIG. 17, the receiving members 19 may have curved portions. The coming plastic bags 1 are engaged with the curved portions so as to face up so that the possibility of the coming plastic bags 1 drawing into between the shutter bars 5 and the feed conveyor 4 can be reduced.

In case that not only the plastic bags 1 but also other sheet products are discharged successively, the sheet products can also be stacked and then fed by the machine.

DESCRIPTION OF THE REFERENCE CHARACTERS

1 plastic bag
3 carriage
4 feed conveyor
5 shutter bar
7, 18 press bar
8, 19 receiving member
9 first drive
10 arm
12 second drive

What is claimed is:

1. An apparatus for stacking and feeding sheet products discharged successively from a discharge position, the apparatus comprising:

a feed conveyor on which the discharged sheet products are stacked and fed downstream along a feed direction, the feed conveyor including a plurality of conveyor belts spaced from each other along a lateral direction normal to the feed direction;

a receiving plate disposed underneath the conveyor belts;

a plurality of projection portions on the receiving plate and spaced apart from each other along the lateral direction, the projection portions extending between, and upwardly from, adjacent conveyor belts, the projection portions engaging and supporting the discharged sheet products above the conveyor belts;

a carriage disposed downstream along the feed direction away from the discharge position;

a plurality of shutter bars disposed between the discharge position and the carriage above the feed conveyor, the shutter bars being spaced from each other with slots between adjacent shutter bars in the lateral direction, the shutter bars being vertically movable along a vertical direction normal to the feed direction and the lateral direction, the shutter bars having upper ends and lower ends arranged along the vertical direction, the shutter bars having an abutment surface against which the discharged sheet products collide;

a shutter drive for raising and lowering the shutter bars along the vertical direction between a raised position and a lowered position;

a plurality of protrusion bodies supported on the carriage and spaced from each other along the lateral direction, each of the protrusion bodies protruding upstream along the feed direction through the slots and past the shutter bars, each of the protrusion bodies having upper surfaces;

a first protrusion body drive mounted on the carriage and configured to move the protrusion bodies from an elevated position above the discharged sheet products on the feed conveyor until a predetermined number of the discharged sheet products is stacked on the feed conveyor as a stack, to a pressed position in which the protrusion bodies press and nip the stack against the feed conveyor;

the lower ends of the shutter bars being positioned in the raised position to an elevation higher than a top of the stack, and lower than the upper surfaces of the protrusion bodies;

a second carriage drive configured to move the carriage and the protrusion bodies downstream in conjunction with the feed conveyor moving the stack downstream along the feed direction in the raised position of the shutter bars, and to return the carriage and the protrusion bodies upstream; and successive discharged sheet products being received on the protrusion bodies from the discharge position without interruption.

2. The apparatus according to claim 1, wherein the protrusion bodies include press bars having tip end portions that engage and press on the stack on the feed conveyor.

3. The apparatus according to claim 1, wherein each of the shutter bars is disposed between the conveyor belts along the lateral direction, and wherein the lower ends of the shutter bars are lowered to the receiving surface by the shutter drive when the stack is moved downstream from the shutter bars.

4. The apparatus according to claim 1, wherein the receiving plate has recesses at positions corresponding to the shutter bars respectively, and wherein the lower ends of the shutter bars are lowered below the receiving plate when the shutter bars are lowered.

5. The apparatus according to claim 1, wherein the protrusion bodies include a plurality of receiving members for engaging and supporting the discharged sheet products, and wherein the receiving members have curved upper surfaces to impart their curvature to, and stiffen, each discharged sheet product in turn.

6. An apparatus for stacking and feeding sheet products discharged successively from a discharge position, the apparatus comprising:

a feed conveyor on which the discharged sheet products are stacked and fed downstream along a feed direction;

a carriage disposed downstream along the feed direction away from the discharge position;

a plurality of shutter bars disposed between the discharge position and the carriage above the feed conveyor, the shutter bars being spaced from each other with slots between adjacent shutter bars along a lateral direction normal to the feed direction, the shutter bars being vertically movable along a vertical direction normal to the feed direction and the lateral direction, the shutter bars having upper ends and lower ends arranged along the vertical direction, the shutter bars having an abutment surface against which the discharged sheet products collide;

a shutter drive for raising and lowering the shutter bars along the vertical direction between a raised position and a lowered position;

a plurality of protrusion bodies supported on the carriage and spaced from each other along the lateral direction, each of the protrusion bodies protruding upstream along the feed direction through the slots and past the shutter bars, each of the protrusion bodies having upper surfaces, the protrusion bodies including a plurality of receiving members for engaging and supporting the discharged sheet products, the receiving members having curved upper surfaces to impart their curvature to, and stiffen, each discharged sheet product in turn;

a first protrusion body drive mounted on the carriage and configured to move the protrusion bodies from an elevated position above the discharged sheet products on the feed conveyor until a predetermined number of the discharged sheet products is stacked on the feed conveyor as a stack, to a pressed position in which the protrusion bodies press and nip the stack against the feed conveyor;

the lower ends of the shutter bars being positioned in the raised position to an elevation higher than a top of the stack, and lower than the upper surfaces of the protrusion bodies;

a second carriage drive configured to move the carriage and the protrusion bodies downstream in conjunction with the feed conveyor moving the stack downstream along the feed direction in the raised position of the shutter bars, and to return the carriage and the protrusion bodies upstream; and successive discharged sheet products being received on the protrusion bodies from the discharge position without interruption.

7. The apparatus according to claim 6, wherein the protrusion bodies include press bars having tip end portions that engage and press on the stack on the feed conveyor.

8. The apparatus according to claim 6, wherein the feed conveyor includes a plurality of conveyor belts spaced from each other along the lateral direction; and a receiving plate disposed underneath the conveyor belts; and wherein each of the shutter bars is disposed between the conveyor belts along the lateral direction, and wherein the lower ends of the shutter bars are lowered to the receiving plate by the shutter drive when the stack is moved downstream from the shutter bars.

9. The apparatus according to claim 8, wherein the receiving plate has recesses at positions corresponding to the shutter bars respectively, and wherein the lower ends of the shutter bars are lowered below the receiving plate when the shutter bars are lowered.

10. The apparatus according to claim 6, wherein the feed conveyor includes a plurality of conveyor belts spaced from each other along the lateral direction; and a receiving plate disposed underneath the conveyor belts; and a plurality of projection portions on the receiving plate and spaced apart from each other along the lateral direction; and wherein the projection portions extend between, and upwardly from, adjacent conveyor belts; and wherein the projection portions engage and support the discharged sheet products above the conveyor belts.

* * * * *